US005921092A

United States Patent [19]

Behr et al.

[11] Patent Number: 5,921,092

[45] Date of Patent: Jul. 13, 1999

[54] FLUID DEFROST SYSTEM AND METHOD FOR SECONDARY REFRIGERATION SYSTEMS

[75] Inventors: John A. Behr, Defiance; John M. Roche, Ballwin; Doron Shapiro, St. Louis, all of Mo.

[73] Assignee: Hussmann Corporation, Bridgeton, Mo.

[21] Appl. No.: 09/039,902

[22] Filed: Mar. 16, 1998

[51] Int. Cl.[6] ..... F25B 41/00

[52] U.S. Cl. ..... 62/81; 62/277; 62/155; 62/156

[58] Field of Search ..... 62/277, 81, 155, 62/156, 278

[56] References Cited

U.S. PATENT DOCUMENTS

| | | | |
|---|---|---|---|
| 2,315,379 | 3/1943 | Robson | 62/99 X |
| 2,669,848 | 2/1954 | Fujii | 62/3 |
| 2,986,903 | 6/1961 | Kocher et al. | 62/333 |
| 3,210,957 | 10/1965 | Rutishauser et al. | 62/255 |
| 3,280,579 | 10/1966 | Kayl | 62/156 |
| 3,363,430 | 1/1968 | White | 62/183 |
| 3,590,595 | 7/1971 | Briggs | 62/197 |
| 3,675,441 | 7/1972 | Perez | 62/278 |
| 4,000,626 | 1/1977 | Webber | 62/175 |
| 4,025,326 | 5/1977 | Leonard, Jr. | 62/175 |
| 4,280,335 | 7/1981 | Perez et al. | 62/332 |
| 4,344,296 | 8/1982 | Staples et al. | 62/175 |
| 4,751,823 | 6/1988 | Hans | 62/201 |
| 4,819,444 | 4/1989 | Meckler | 62/238.6 |
| 5,038,574 | 8/1991 | Osborne | 62/101 |
| 5,042,262 | 8/1991 | Gyger et al. | 62/64 |
| 5,335,508 | 8/1994 | Tippmann | 62/129 |
| 5,440,894 | 8/1995 | Schaeffer et al. | 62/203 |
| 5,483,806 | 1/1996 | Miller et al. | 62/402 |
| 5,727,393 | 3/1998 | Mahmoudzadeh | 62/81 |
| 5,743,102 | 4/1998 | Thomas et al. | 62/185 |

FOREIGN PATENT DOCUMENTS

| | | |
|---|---|---|
| 340115 | 2/1989 | European Pat. Off. . |
| 488553 | 6/1992 | European Pat. Off. . |
| 483161 | 6/1994 | European Pat. Off. . |
| 372897 | 4/1923 | Germany . |
| 2112362 | 9/1972 | Germany . |

*Primary Examiner*—Henry Bennett
*Assistant Examiner*—Marc Norman
*Attorney, Agent, or Firm*—Richard G. Heywood

[57] ABSTRACT

A fluid defrost system and method for defrosting the cooling coil of a product fixture normally cooled by circulating a cold secondary liquid coolant in a cooling loop refrigerated by a primary vapor compression system having compressor, condenser and evaporator means; the defrost system comprising a heat exchanger associated with the condenser means for warming secondary liquid coolant in a heating loop, and means for controlling the circulation of warm liquid coolant through the heat exchanger and cooling coil.

40 Claims, 6 Drawing Sheets

FLUID DEFROST SYSTEM AND METHOD FOR SECONDARY REFRIGERATION SYSTEMS

BACKGROUND OF THE INVENTION (a) Field of the Invention

The invention relates generally to the commercial refrigeration art, and more particularly to fluid defrost system and method improvements in secondary refrigeration systems for cooling food product merchandisers or the like.

(b) Related Cases

This application discloses improvement subject matter related to (1) co-pending and commonly-owned application Ser. No. 08/631,104 filed Apr. 12, 1996 U.S. Pat. No. 5,727,393 for Multi-Stage Cooling System for Commercial Refrigeration (Mahmoudzadeh), and (2) co-pending and commonly-owned application Ser. No. 08/632,219 filed Apr. 15, 1996 U.S. Pat. No. 5,743,102 for Strategic Modular Secondary Refrigeration (Thomas et al).

(c) Description of the Prior Art

World-wide environmental concerns over the depletion of the protective ozone layer and resultant earth warming due to releases of various CFC (chlorofluorocarbon) base chemicals into the atmosphere has resulted in national and international laws and regulations for the elimination and/or reduction in the production and use of such CFC chemicals. The refrigeration industry in general has been a primary target for government regulation with the result that some refrigerants, such as R-502, previously in common use in commercial foodstore refrigeration for many years are now being replaced by newer non-CFC types of refrigerants. However, such newer refrigerants are even more expensive than the more conventional CFC types, thereby raising basic cooling system installation and maintenance costs and creating higher loss risks in conventional backroom types of commercial systems having long refrigerant piping lines from the machine room to the store merchandisers. For instance, in a typical large supermarket of 50,000 square feet, the aggregate refrigeration capacity of the various food merchandisers, coolers and preparation rooms may exceed 80 tons (1,000,000 BTU/hr.) including 20 tons of low temperature refrigeration and 60 tons of medium temperature refrigeration. In this example, the piping length would be on the order of 18,000 feet of conduit requiring about 1800 pounds of refrigerant. One of the newer refrigerants is R-404A (an HFC chemical) that now costs about $8.00 per pound.

Obviously, the refrigeration industry has been is concerned over its role in the environmental crisis, and has been seeking new refrigeration systems and applications for non-CFC chemicals in attempting to help control the CFC problem while maintaining high efficiency in food preservation technology.

So-called "cascade" or staged refrigeration systems are well-known, especially where relatively low temperatures are required in controlled zones such as in industrial refrigeration and cryogenic applications. Commonly-owned U.S. Pat. No. 5,440,894 discloses improvements in commercial foodstore refrigeration systems utilizing modular first stage closed-loop refrigeration units of the vapor compression type that are strategically located throughout the foodstore shopping arena in close proximity to groups of temperature-associated merchandisers (i.e. "close coupled"), and preferably having an efficient condenser heat exchange network through a cascade-type coolant circulating system. This prior cascade-type system is representative of a typical "two fluid" approach to multi-stage refrigeration in that the mechanical vapor-compression refrigeration stage is still the final, direct refrigeration step in the controlled cooling of the merchandiser evaporator coils for maintaining product zone temperatures, and the other liquid or fluid coolant is circulated in cooling heat exchange with the refrigeration system condensers. Commonly-owned U.S. patent application Nos. 08/631,104 U.S. Pat. No. 5,227,393 and 08/632,219 U.S. Pat. No. 5,743,102 (previously cited) also disclose cascade-type "two fluid" systems, now more commonly called "secondary refrigeration systems" in which the vapor compression central system cools a secondary non-compressible coolant fluid, such as propylene glycol solutions, for direct distribution to the cooling coils of product display fixtures or the like. Other prior art references of the "two fluid" type include the following patents:

| U.S. Patents | Date | Inventor |
|---|---|---|
| 3,210,957 | 10/1965 | Rutishauser |
| 3,675,441 | 07/1972 | Perez |
| 4,280,335 | 07/1981 | Perez et al |
| 4,344,296 | 08/1982 | Staples et al |
| 5,335,508 | 08/1994 | Tippmann |

EPO publication No. 0483161 B1 published Jun. 29, 1994 discloses another multi-stage refrigeration system in which a central, vapor-compression, refrigeration unit cools a "secondary" coolant fluid circulated for the direct primary cooling of a medium temperature unit and thence in series flow for cooling the condenser of a self-contained fixture.

In any commercial system to maintain the product zone temperatures for frozen foods, fresh meat and dairy products or other refrigerated products, it is known that the cooling (evaporator) coils or heat exchangers for such product zones must be maintained at or below the freezing point of water with a resultant frost or ice build-up during cooling operations. In order to maintain the heat transfer efficiency of such heat exchangers to cool circulating air flow to the product zone and minimize unwanted temperature rise in the product area, periodic defrosting of the heat exchangers must be performed as expeditiously as possible. Conventional forms of defrosting the evaporator coils in low and medium temperature vapor-compression systems include electric, hot gas and saturated gas defrosting and some off-cycle defrosting in higher temperature systems. The use of hot gas from the compressor discharge is widely used in refrigeration, and utilizing saturated gas from the receiver (as taught by Quick U.S. Pat. No. 3,343,375) is also known in the industry. The secondary refrigeration systems of co-pending U.S. patent application Nos. 08/631,104 U.S. Pat. No. 5,727,393 and 08/632,219 U.S. Pat. No. 5,743,102 disclose the use of hot coolant, similar to hot gas, for low and medium temperature system operations, but over-heating problems have been encountered.

SUMMARY OF THE INVENTION

The invention is embodied in a fluid defrost system and method for defrosting the cooling coil of a product fixture normally cooled by circulating cold secondary liquid coolant in a cooling loop refrigerated by a primary vapor compression system having compressor, condenser and evaporator means, and including warm heat exchanger means downstream of the condenser means and control means for controlling the flow of warm liquid coolant through the heat exchanger and cooling coil. More specifically, the invention comprises a multi-stage commercial cooling system and method for cooling a heat transfer unit for a product space to be cooled; including a first cooling stage having a refrigerant compressor, condenser and evaporator in a closed refrigeration circuit; and a second cooling stage having pumping means for circulating non-compressible coolant fluid through a first cooling loop constructed and arranged with the evaporator for the normal cooling of the heat transfer unit, and a second defrosting loop in by-pass relation with the first loop and constructed and arranged for heating coolant fluid for defrosting the heat transfer unit; and control means for selectively controlling the circulation of heated coolant fluid for defrosting.

A principal object of the present invention is to provide a fluid defrosting system for a secondary cooling system for the efficient refrigeration of foodstore merchandisers using non-compressible coolant fluids and with minimal use of vapor-compression refrigerants, and for the efficient periodic defrosting of the cooling coils of such merchandisers.

Another object is to provide a multi-stage cascade-type secondary system utilizing a non-compressible coolant fluid as the principal refrigerating medium for foodstore fixtures, and having a close coupled vapor-compression refrigeration circuit for refrigerating the coolant fluid.

Another object is to provide a secondary coolant fluid system utilizing non-compressible fluid coolants of the glycol-type, and to provide a warm fluid defrosting system for selectively defrosting the heat transfer cooling coils in the system.

A further specific object of the invention is to provide a coolant fluid defrost system and method that captures waste heat from the condensing phase of a vapor compression refrigeration circuit, and provides efficient defrosting using a static charge of such heated coolant fluid.

Yet another object is to provide a multi-stage cascaded system having a high thermal efficiency using a heat exchanger method of heating secondary coolant fluid for defrost by using waste heat generated in the primary cooling stage.

Another object is to provide a secondary cooling and defrosting system that uses a preselected coolant fluid as the principal cooling/defrosting medium, that recaptures waste heat from the primary refrigerating phase, and that does not overheat the secondary coolant or the defrosting fixture and product therein.

These and other objects and advantages will become more apparent hereinafter.

DESCRIPTION OF THE DRAWINGS

For illustration and disclosure purposes, the invention is embodied in the construction and arrangement and combinations of parts hereinafter described. In the accompanying drawings forming part of the specification and wherein like numerals refer to like parts wherever they occur.

DESCRIPTION OF THE PREFERRED EMBODIMENTS

The present invention pertains to multi-stage or secondary refrigeration systems utilizing a single phase (non-compressible) coolant fluid as the principal or direct product cooling medium, such coolant fluid typically being cooled by a vapor compression system as the primary refrigeration process. Such systems are preferably "close coupled" in that the vapor phase system is located as near as possible to the product loads to be cooled. In the refrigeration industry the term "commercial" is generally used with reference to foodstore and other product cooling applications in the low and medium temperature ranges, as distinguished from air conditioning (at high temperature) and heavy duty industrial refrigeration applications in warehousing and processing plants or the like. Thus, "low temperature" as used herein shall refer to product zone temperatures in the range of −20° F. to 0° F.; and "medium temperature" (sometimes called "standard temperature") means product temperatures in the range of 25° F. to 50° F. It will also be understood that low temperature products require cooling coil or like heat transfer temperatures in the range of about −35° F. to −5° F.; and medium temperature cooling operations are produced with cooling coil or like heat transfer temperatures in the range of about 15° F. to 40° F. Also, for disclosure purposes, the term "coolant fluid" will refer to any suitable single phase liquid solution that will retain its flowability at the required medium and/or low commercial temperatures of the heat transfer units in the product merchandisers or cooling zones; and the term "glycol" may be used herein in a generic sense to identify propylene glycol solutions and/or various other chemical solutions known in the industry and useful in medium and low temperature applications.

Figure 1:
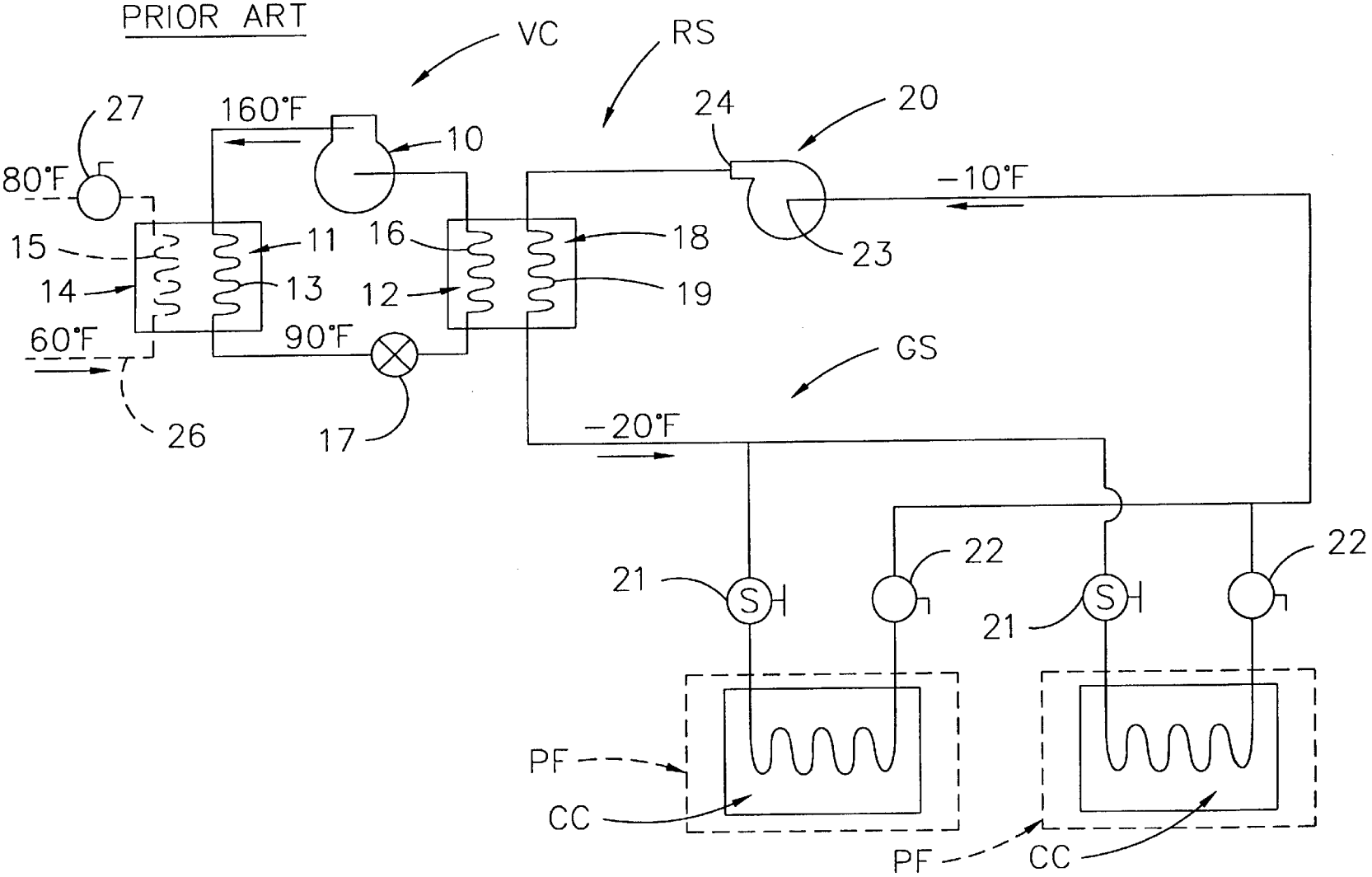
FIG. 1 PRIOR ART
FIG. 1 is a diagrammatic view of a typical secondary refrigeration system of the prior art.

FIG. 1 of the drawings illustrates diagrammatically a typical prior art form of a basic secondary multi-stage coolant fluid commercial refrigeration system RS for maintaining design low or medium temperatures in the heat transfer cooling coils CC of product fixtures PF or the like. In its simplest form, the multi-stage system RS includes a close-coupled vapor compression system VC which performs the primary refrigeration process and includes compressor means 10, condenser means 11 and evaporator means 12 in a sequential closed refrigeration circuit. The compressor means 10 in a commercial refrigeration application will typically have two or more multiplexed, parallel-linked compressors, and U.S. Pat. No. 5,440,894 teaches that up to about ten (10) small scroll compressors may be used. The condenser means 11 may be air cooled as in typical roof mounted units (not shown), but preferably has its condenser coil 13 constructed and arranged in a heat exchanger unit 14 also having a cooling coil or other liquid coolant circuit 15 for cooling the condenser 13 from an outside coolant liquid sources, as through line 26. Thus, the compressor means 10 discharges hot (i.e. 160°–290° F.) compressed refrigerant vapor to the condenser coil 13 where it is cooled to condensing temperature with the heat of rejection being dissipated to the atmosphere (air cooled) or transferred to the liquid cooling medium (water or glycol cooled) flowing through outside cooling loop 26 and balancing valve 27. Warm (i.e. 90° F.) liquid condensate from the condenser 13 thence flows through a liquid line to evaporator coil 16 of the evaporator means 12 through expansion valve 17. The evaporator coil 16 of the primary system VC is constructed and arranged in a cold heat exchanger 18 also having a "cold" transfer coil or like transfer circuit 19 forming the cold source for liquid coolant in the secondary "glycol" system GS. The refrigerant expands in evaporator coil 16 and removes heat from the liquid coolant in the heat exchanger 19 and is thus vaporized and returned to the suction side of the compressor means 10 to complete the refrigeration circuit.

Still referring to FIG. 1, in the basic secondary system GS, pumping means 20 circulates cold (i.e. −20° F.) liquid coolant in a cold loop from the cold transfer coil 19 to the fixture cooling coils CC through solenoid control valves 21 or the like. The coolant removes heat from the fixture and the warmer (i.e. −10° F.) outflow side of these coils CC may have preset balancing valves 22 for regulating or adjusting the flow of liquid coolant through the cooling loop. FIG. 1 shows that the negative pressure side 23 of pump 20 is connected to draw liquid coolant from the fixture cooling coils CC and displace it on the positive pressure side 24 to the cold heat exchanger 18, but it will be understood that the circulation of coolant in the cold refrigerating loop could be in the reverse direction. The primary refrigeration process VC as applied in the invention is preferably close-coupled to limit the amount of refrigerant charge required as taught in U.S. Pat. No. 5,440,894 and co-pending application No. 08/632,219 U.S. Pat. No. 5,743,102—although it will be understood that roof-mounted condensers are within the scope of those patents, particularly in applications where the condensing unit racks are mezzanine-mounted and the piping runs to and from the condenser are relatively short. The evaporator (12) lowers the "cold" secondary liquid coolant temperature in the cooling loop while the condenser (11) rejects heat to another fluid coolant circuit. Since these coolants are single-phase (non-compressible), they can be conveniently pumped to and from remote heat transfer locations, and such coolants are also designed to be non-toxic and environmentally safe. The cooling coils CC of the product fixture PF may be of the well-known finned heat exchanger type designed for cooling moist air flow thereacross to sub-freezing temperatures.

The improvements of the present invention are embodied in fluid defrost arrangements and methods for the basic secondary refrigeration system RS just described. Therefore, since FIGS. 2 and 3 disclose the same embodiment of the invention except for reversed pumping directions of coolant flow in the secondary glycol system GS, they will be described using the same reference numbers—in the "100" series—for both figures. One of the most prevalent problems in commercial refrigeration is that refrigerating moist air to sub-freezing temperatures through finned (or other) heat exchangers results in frosting and ice buildup on the fins and coil surfaces, thus blocking air flow and reducing heat transfer efficiency. Periodic defrosting is necessary, but desirably should be as short as possible with the application of minimum heat so as to obviate any substantial rise in food product temperature.

Figure 2:
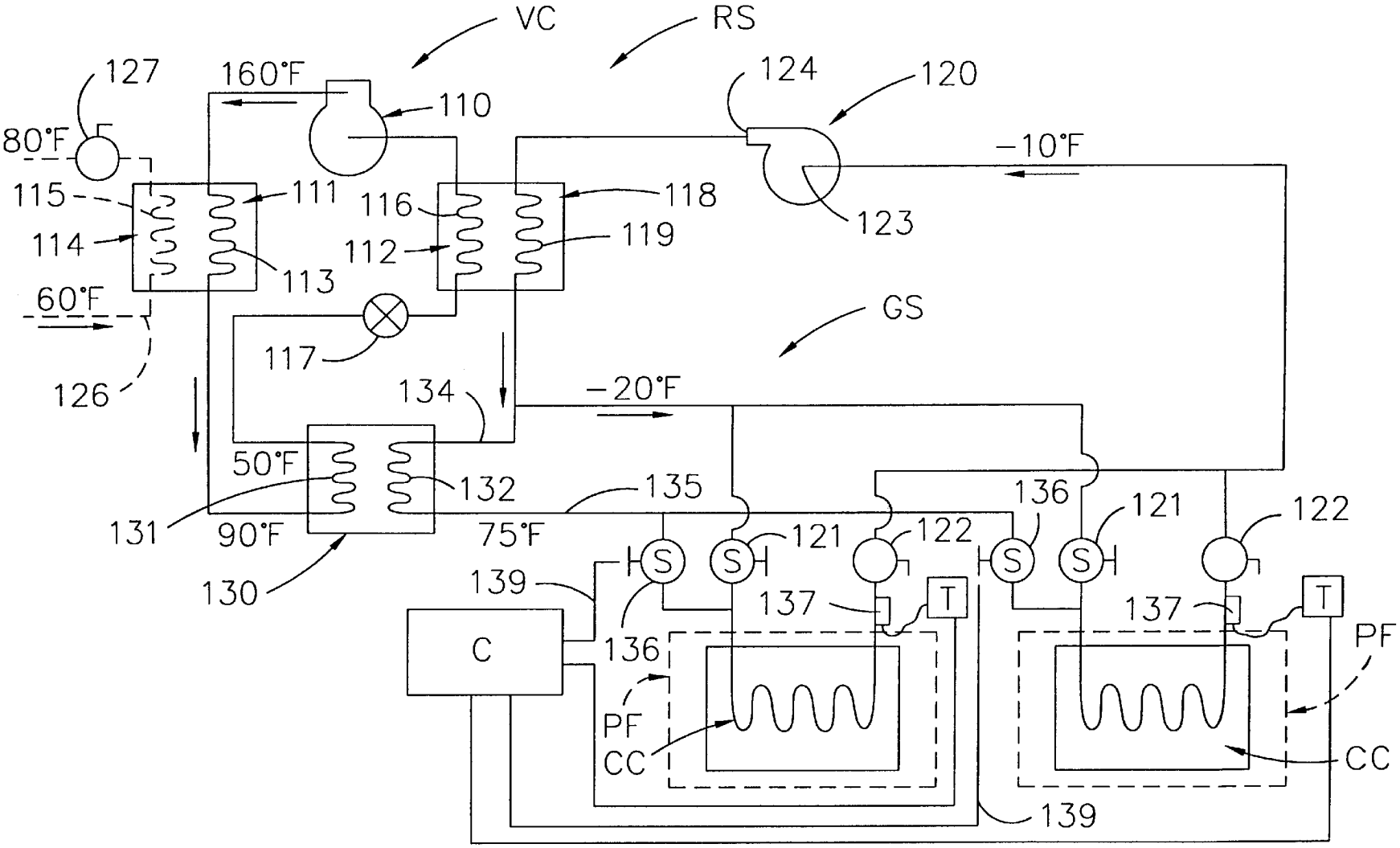
FIG. 2 is a diagrammatic view of one embodiment of a secondary refrigeration system of the present invention.
Figure 3:
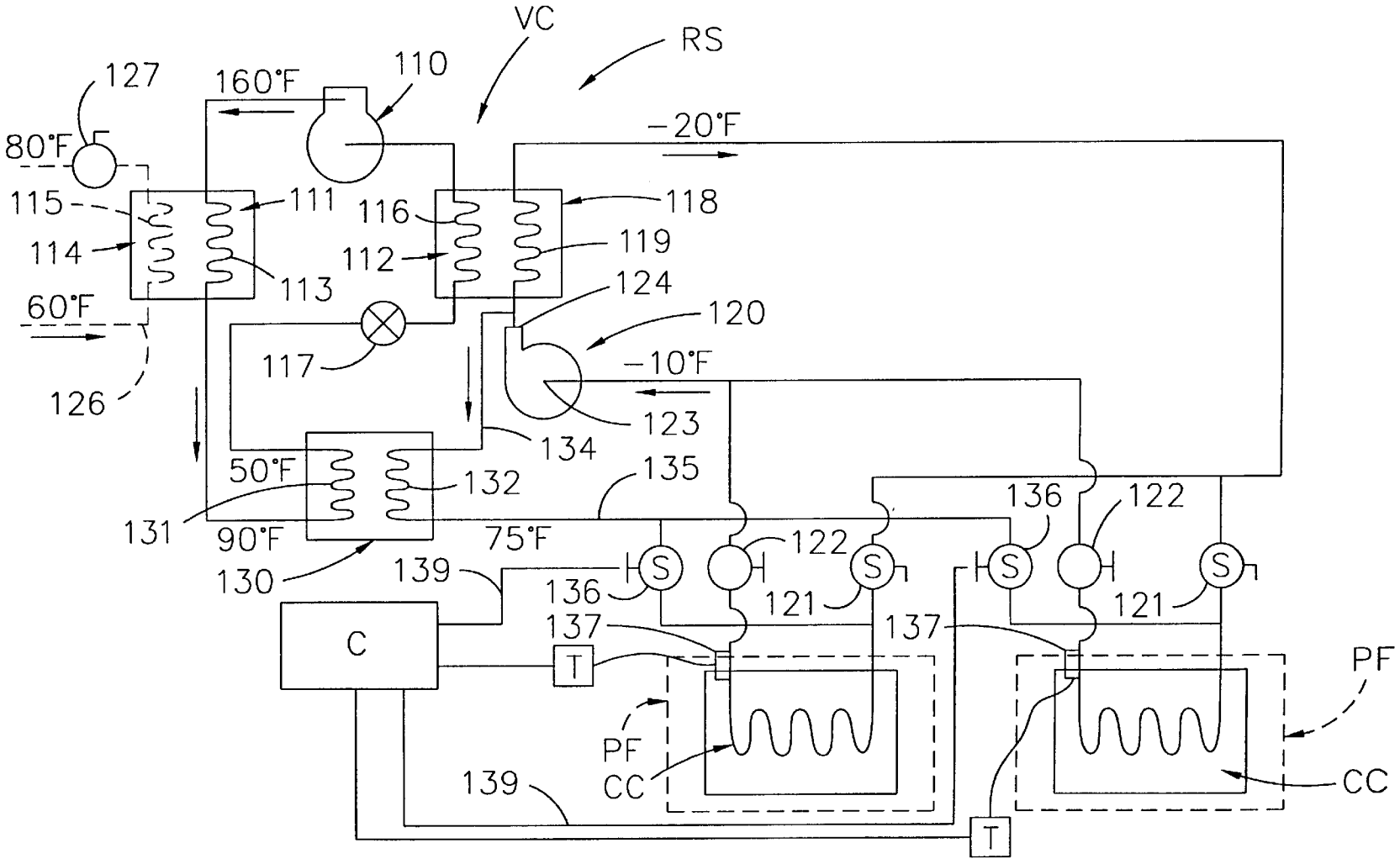
FIG. 3 is a reverse flow modification of the FIG. 2 embodiment.

According to the invention, heat for defrosting is derived from the condensing operation and the FIG. 2 and 3 embodiment employs a warm heat exchanger 130 downstream of the condenser 111. The heat exchanger 130 has a first or input warming liquid circuit 131 connected in series refrigerant flow between the outlet of the condenser coil 113 and the expansion valve 117, and thus receives warm liquid condensate at temperatures in the magnitude of 90°–120° F. The warm heat exchanger 130 also has a second or output warmed coolant circuit 132 that forms part of a heated defrost loop of the glycol system GS. This heated circuit is connected by conduit 134 on its inlet side to the positive displacement side 124 of the pump 120, and is connected on its outlet side 135 to defrost control solenoid valves 136 leading to the fixture cooling coils CC in parallel by-pass relation to the cold coolant circuit delivery lines through the solenoid valves 121. Clearly, a defrost cycle is initiated by closing the cold loop solenoid valve 121 and opening the warm or defrost loop solenoid valve 136 to the fixture coil selected for defrost. FIG. 2 shows the cold loop flow path of coolant to be from the fixture coils CC at a return temperature of about −10° F. to the negative side of the pump 120 and thence to the cold heat exchanger 118 for cooling to about −20° F. and recirculation in the cold loop to the cooling coils CC for the normal refrigeration thereof. In defrost, the −20° F. temperature coolant is diverted to the warm heat exchanger which raises the coolant temperature to a warm 75° F. temperature for defrost purposes, while subcooling the liquid refrigerant in the first input (condenser outflow) circuit 131 to a temperature of about 50° F. In the FIG. 3 form of this embodiment, the pump 120 draws return flow coolant at about −10° F. from the cooling coils CC and then displaces it on the positive side either to the cold heat exchanger 118 for cooling or to the warm heat exchanger 130 in the defrost loop. Clearly, the FIG. 3 circulation path will be more efficient in the defrost loop heat exchanger. It may be noted that the balancing valves 122 are typically preset to establish an overall system flow balance among the multiple coils of the merchandiser fixtures PF.

In the FIG. 2 and 3 embodiments, a defrost cycle is initiated either on a scheduled time basis or on demand such as by sensing coolant temperatures or air flow parameters at the cooling coils CC. In any case, the controller C closes the cold valve 121 to the fixture coil CC and opens the defrost valve 136 thereto so that the defrost loop from the pump 120 through the warm heat exchanger 130 and through the defrosting coil is now open to the flow of warmed (75° F.) coolant for defrosting. The warm coolant, of course, pushes the cold coolant mass out of the defrosting coil, and the warm coolant immediately begins to heat the coil (tubular coil bundle and fins) from the inside to melt the ice thereon as this warm coolant flows through the coil. In the past, hot coolant (at compressor discharge temperature) was used for defrost and would flow through the coil throughout the entire defrost cycle including an initial ice melting period and a final drip time phase to thereby insure a clean coil. However, such high coolant heat loads caused overheating problems in the fixture coil and product areas, as well as potential chemical breakdown of the coolant itself, and increased the cooling burden in the cold coolant loop.

Figure 6:
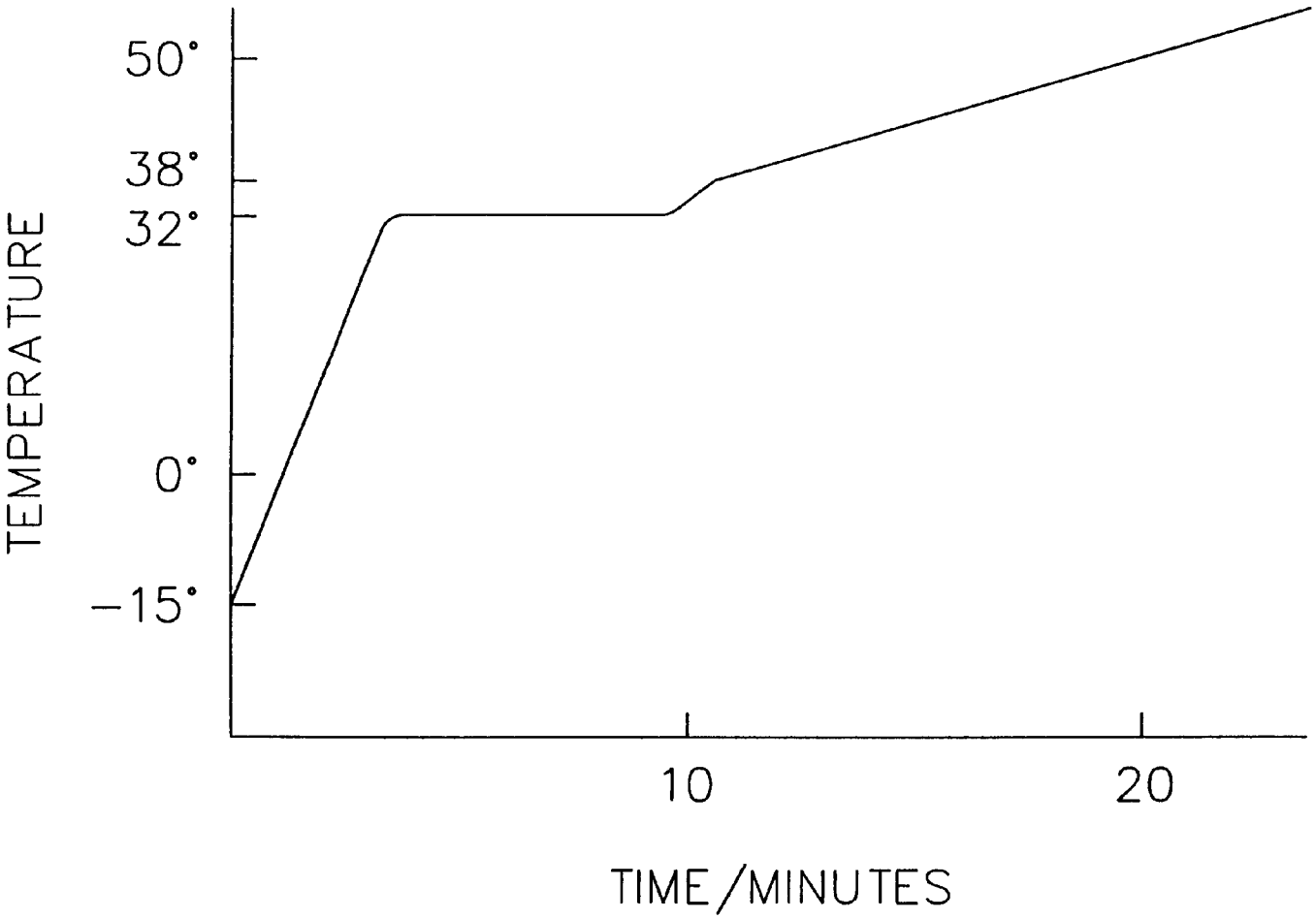
FIG. 6 is a flow diagram of a defrosting cycle of the invention.

One defrosting feature of the invention is to use desuperheated liquid condensate—in which the heat of rejection has been removed and the temperature is substantially below the point that chemical breakdown starts to occur (i.e. about 150° F.). Another feature of the present fluid defrost system and method resides in the flow control of warm defrost coolant in the cooling coils CC. A sensing bulb 137 or like temperature/pressure sensor is provided on the outlet from the cooling coil CC to monitor the warm coolant outflow temperature after initiating the defrost. When a predetermined outlet temperature is sensed, a thermostat T opens the control circuit 139 through a controller unit C to close the defrost solenoid valve 136. This stops the flow of warm defrosting coolant through the cooling coil CC, and establishes a static charge of warm coolant to be held in the coil CC for a preselected final time period to permit full defrosting to be completed. At the end of the time delay, as programmed in the controller C, the cold coolant solenoid valve 121 is opened and refrigeration of the defrosted cooling coil CC is resumed. FIG. 6 graphically illustrates a defrost cycle of the present invention and shows an initial defrost period of about 10 minutes (from 5 to 12 minutes) in which the flow of warm coolant through the coil rapidly raises the coil temperature from a normal cooling temperature (i.e. −15° F.) up to 32° F. for melting the ice on the coil. Heat exchange between the warm coolant and the coil will continue on a 32° F. plateau until all of the ice is gone, and the warm coolant flow will then start a further upswing in coil temperature. Since the final drip time phase of the defrost cycle is generally longer, such as 10 to 15 minutes, the invention provides for the time delay period to start upon sensing a preselected coolant temperature above 32° F. at the coil outlet (i.e. 38° F.). The static charge of warm liquid coolant thus trapped in the coil by closing the defrost valve 136 forms a heat sink mass that will induce the further rise in coil temperature (i.e. up to 50° F.) to produce a clean cooling coil CC. Thus, it has been discovered that continuous circulation of warm coolant through the defrosting coil CC throughout the entire defrost period is not necessary to maintain defrosting temperatures; and that filling the coil one time with warm defrost coolant near ambient temperature (about 75° F.) will be sufficient to complete the final defrost stage of the coil. Using a defrost termination thermostat T and controller C allows the use of single defrost loop piping in which the upstream warm defrost fluid can become stagnant following defrost without dumping excess warm coolant into the cold piping loop or adding to the fixture heat load.

Figure 4:
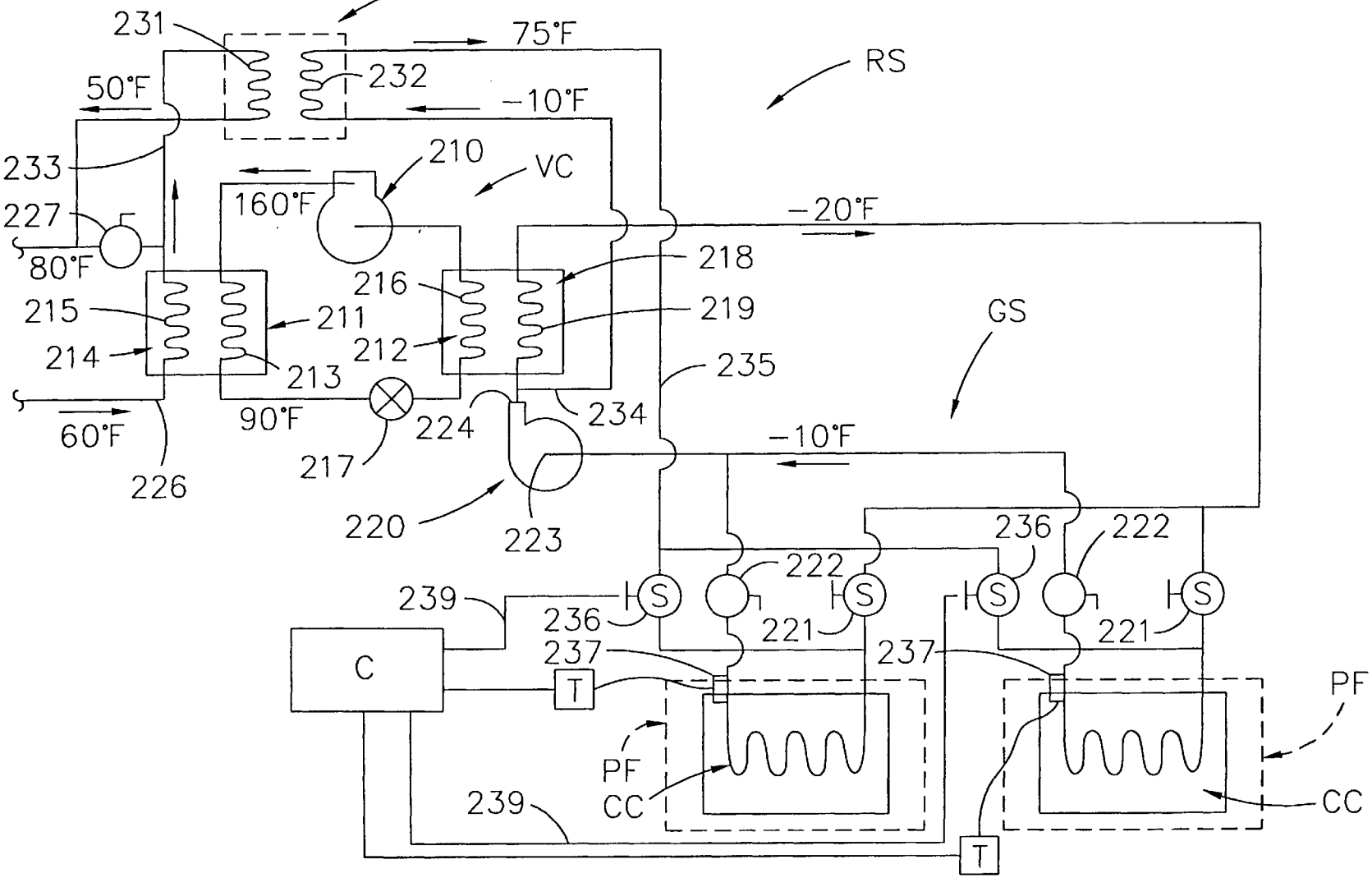
FIG. 4 is a diagrammatic view of a second embodiment of the secondary refrigeration system of the invention.

Referring now to FIG. 4, another embodiment of the invention is shown with common components marked in the "200" series. In this embodiment, the warm heat exchanger 230 is constructed and arranged with its first or input warming liquid circuit 231 in series flow relation through line 233 with the liquid coolant circuit 215 in condenser heat exchanger 214. Thus, the heat of rejection from condenser 211 is transferred to the condensing coolant liquid flow in the coolant circuit 215 and thence downstream from the condenser 211 to the warm heat exchanger 230. In this embodiment the balancing valve 227 may be preset or pressure controlled to determine an adequate condenser flow rate. It will be seen that the temperatures of the FIG. 4 embodiment are comparable to the temperatures in the FIG. 2/3 embodiment, and the defrosting process is carried out the same way as previously described.

Figure 5:
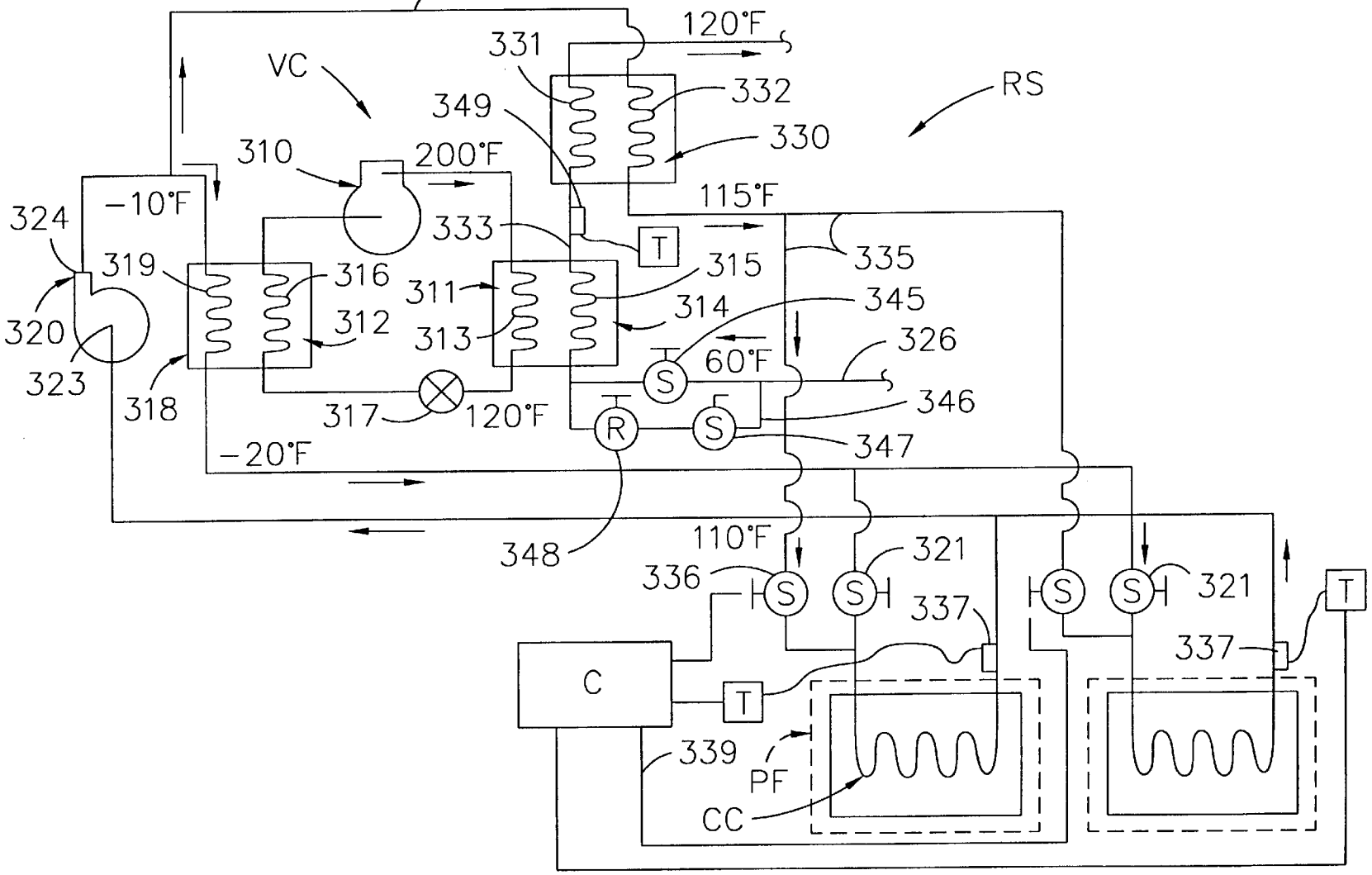
FIG. 5 is a diagrammatic view of the presently preferred embodiment of the invention.

FIG. 5 shows a presently preferred embodiment of the invention similar in most respects to the FIG. 4 form of the invention. The reference numerals in FIG. 5 are in the "300" series. In FIG. 5 the condenser 311 is liquid cooled (as in FIG. 4) by circulating a single phase coolant through a liquid circuit 315 in condenser heat exchanger 314, and the heat of rejection from condenser 311 is thus transferred downstream to the first or input warming liquid circuit 331 of warm heat exchanger 330.

FIG. 5 illustrates that the compressor head pressure in some vapor compression systems may be permitted to float upward and 200° F. or higher refrigerant vapor temperatures may be produced. The flow of liquid coolant in the condenser cooling circuit 315 of heat exchanger 314 is controlled on the input side during defrost as a means of regulating defrost fluid temperature. Thus, the main coolant input line 326 has a normally open solenoid valve 345 for the unrestricted flow of liquid coolant at an input temperature of about 60° F. to the condenser heat exchanger 314 during normal refrigeration. A defrost by-pass line 346 has a normally closed solenoid valve 347 and an inline throttling valve 348. During defrost, the controller C may be programmed to close the valve 345 and open the by-pass line 346 to provide coolant throttling control by the valve 348 in response to coolant temperature in outlet line 333 as sensed by sensor 349 or, alternatively, by sensing pressure in the refrigeration circuit (i.e. compressor head pressure or condensate outflow pressure). The throttling valve 348 may be a pressure-actuated fluid (water) control valve R. Clearly, by throttling the condenser coolant during defrost, the temperature of such coolant can be regulated to control the transfer heat in warm heat exchanger 330 to achieve preselected design defrost temperatures in the heating loop and fixture cooling coils CC.

In operation, fluid defrost of the FIG. 5 embodiment is similar to the embodiments of FIGS. 2/3 and FIG. 4. The periodic defrosting schedule for the cooling coils CC of each fixture PF may be preset on a time basis or initiated on demand by other sensed parameters in the fixture as will be understood by those skilled in the art. The defrost cycle is started by closing the condenser coolant input valve 345 and opening by-pass line 346 for flow regulation by the throttling valve 348 and simultaneously closing the cold loop solenoid valve 321 and opening the defrost loop valve 336 to the defrosting cooling coil CC. The defrost coolant outflow temperature from the coil CC is monitored by a sensor 337 and thermostatic control T, and after the initial ice melting phase, the defrost valve 336 is closed at a preselected coolant temperature value by the controller C. A time delay is then started while holding a full static charge of warm defrost coolant in the coil for defrosting, and the time delay may have a pre-programmed or fixed time duration or may be terminated on a sensed temperature basis or a combination of time and temperature depending upon which occurs first. At the end of the time delay, the cold coolant valve 321 is opened to provide normal refrigeration.

It will be understood that the secondary refrigeration systems of the commercial foodstore type most generally serve several product fixtures having about the same temperature requirements, and that defrosting of such fixtures will be carried out on a staggered basis. Since the return of warm defrost coolant back into the cooling loop might add an extra cooling burden to the evaporative cold heat exchanger (112, 212, 312), it is desirable to minimize the volume of such warm coolant heat loads as well as magnitude of coolant heat used for defrost. The present invention addresses and meets both of these objectives.

From the foregoing it will be seen that the objects and advantages of the invention have been fully met. The scope of the invention is intended to encompass changes and modifications as will be apparent to those skilled in the commercial refrigeration art, and is only to be limited by the scope of the claims which follow.

What is claimed is:

1. A fluid defrost system for defrosting the cooling coil of a product fixture normally cooled by circulating cold secondary liquid coolant therethrough in a cooling loop refrigerated by a primary vapor compression system having compressor, condenser and evaporator means; the defrost system comprising a defrosting loop constructed and arranged for circulating warm secondary liquid coolant through the cooling coil, said defrosting loop including warm heat exchanger means downstream of the condenser means and control means for controlling the flow of warm liquid coolant in the defrosting loop and cooling coil.

2. The defrost system of claim 1, in which said compressor, condenser and evaporator means are arranged in a closed refrigerant flow circuit and the cooling loop includes a cold heat exchanger associated with the evaporator means, and said warm heat exchanger means has a warming liquid input circuit warmed from the condenser means and a warmed coolant output circuit.

3. The defrost system of claim 2, in which said warm heat exchanger means is constructed and arranged with its warming liquid input circuit directly in the refrigerant flow circuit to receive warm condensate outflow from the condenser means and thereby transfer heat to the warmed coolant output circuit.

4. The defrost system of claim 3, in which said warm heat exchanger means forms a subcooler in the refrigerant flow circuit.

5. The defrost system of claim 3, including pumping means for circulating secondary liquid coolant in said cooling and defrosting loops, said pumping means normally circulating the liquid coolant in the cooling loop to the fixture cooling coil for refrigeration, and during defrosting the liquid coolant is diverted to flow in the defrosting loop through the warmed coolant output circuit and thence to the fixture cooling coil.

6. The defrost system of claim 5, in which the negative pressure side of said pumping means receives cold liquid coolant from said cold heat exchanger and pumps it on the positive displacement side selectively through the cooling loop or the defrosting loop to the fixture cooling coil.

7. The defrost system of claim 5, in which the negative pressure side of said pumping means receives liquid coolant from said fixture cooling coil and pumps it on the positive displacement side selectively through the cooling loop to the evaporator means or through the defrosting loop upstream of said evaporator means.

8. The defrost system of claim 5, in which said condenser means is air cooled.

9. The defrost system of claim 3, in which said condenser means is liquid cooled.

10. The defrost system of claim 2, in which said condenser means is constructed and arranged with a condenser circuit in a condensing heat exchanger unit having a fluid cooling circuit for removing heat from the condenser circuit.

11. The defrost system of claim 10, in which said warm heat exchanger means is constructed and arranged with its warming liquid input circuit in series flow relation downstream of the fluid cooling circuit of said condensing heat exchanger unit.

12. The defrost system of claim 11, including pumping means for circulating secondary liquid coolant in said cooling and defrosting loops, said pumping means normally circulating the liquid coolant in the cooling loop to the fixture cooling coil for refrigeration, and during defrosting the liquid coolant being diverted to flow in the defrosting loop through the warmed coolant output circuit and thence to the fixture cooling coil.

13. The defrost system of claim 12, in which the negative pressure side of said pumping means receives liquid coolant from said fixture cooling coil and pumps it on the positive displacement side selectively through the cooling loop to the evaporator means or through the defrosting loop upstream of said evaporator means.

14. The defrost system of claim 11, in which the fluid cooling circuit of the condenser heat exchanger unit is in a secondary coolant flow loop, and fluid flow control means in said coolant flow loop for regulating the flow of condenser cooling liquid through the fluid cooling circuit and its sequential warming liquid input circuit of the warm heat exchanger means.

15. The defrost system of claim 14, in which said fluid flow control means in said coolant flow loop comprises a throttling valve constructed and arranged for changing the coolant fluid flow characteristics in the secondary coolant flow loop during defrost.

16. The defrost system of claim 15, in which the secondary flow loop has a normally open solenoid valve accommodating the unrestricted flow of condenser cooling liquid to the fluid cooling circuit during normal cooling of the fixture cooling coils.

17. The defrost system of claim 16, in which said throttling valve is arranged in a by-pass line to the normally open solenoid valve, and said fluid flow control means further comprises controller means for controlling cooling liquid flow through the by-pass line during the defrosting of fixture cooling coils.

18. The defrost system of claim 17 including sensing means on the outflow side from the fluid cooling circuit, and said controller means being responsive to temperature or pressure parameters sensed by the sensing means.

19. A fluid defrost system for defrosting the cooling coil of a product fixture normally cooled by circulating cold secondary liquid coolant therethrough in a cooling loop refrigerated by a primary vapor compression system having compressor, condenser and evaporator means; the defrost system comprising a defrosting loop constructed and arranged for circulating warm secondary liquid coolant through the cooling coil, said defrosting loop including warm heat exchanger means constructed and arranged downstream of the condenser means for receiving heat therefrom, and control means for controlling the flow of warm liquid coolant in the defrosting loop and cooling coil including valve means in the cooling and defrost loop inputs to the fixture cooling coil for establishing refrigerating and defrosting cycles, and other flow control means constructed and arranged for determining the nature and timing of the defrost cycle.

20. The defrost system of claim 19, in which the valve means in the cooling loop is closed and the valve means in the defrost loop is opened to initiate a defrost cycle by circulating warm liquid coolant from the warmed coolant output circuit through the fixture cooling coil, and said other flow control means including sensing means for monitoring the outflow temperature of warm liquid coolant from the fixture cooling coil.

21. The defrost system of claim 20, in which said condenser means is constructed and arranged with a condenser circuit in a condenser heat exchanger unit having a fluid cooling circuit for removing heat from the condenser circuit.

22. The defrost system of claim 21, in which said warm heat exchanger means is constructed and arranged with its warming liquid input circuit in series flow relation downstream of the fluid cooling circuit of said condensing heat exchanger unit.

23. The defrost system of claim 22, in which the other flow control means includes by-pass throttling means in the cooling loop to the fluid cooling circuit of the condenser heat exchanger, and means for operating the by-pass throttling means simultaneously with said valve means for initiating the defrost cycle.

24. The defrost system of claim 20, in which said other flow control means includes valve control means responsive to the sensing means for stopping the flow of warm liquid coolant and establishing a static charge thereof in the fixture cooling coil when a predetermined outflow temperature is sensed.

25. The defrost system of claim 24, including timing means for holding the static charge of warm liquid coolant in the fixture cooling coil for a preselected defrosting duration.

26. The method of defrosting the cooling coil of a product fixture normally cooled in a refrigerating phase by circulating cold secondary coolant liquid cooled by a primary vapor compression system having compressor, condenser and evaporator means, comprising the steps of:

circulating secondary coolant liquid to the cooling coil in a heating loop having a warming heat exchanger downstream of the condenser means, and controlling the circulation of warm coolant liquid through the warm heat exchanger and cooling coil during a defrost cycle.

27. The method of claim 26 including the step of monitoring the outlet temperature of warm coolant liquid from the cooling coil during the initial defrosting phase, and stopping the flow of warm coolant liquid in the cooling coil when a predetermined outlet temperature is sensed.

28. The method of claim 27 including the step of establishing a static charge of warm coolant liquid in the cooling coil to form a heat sink mass therein during the terminal phase of the defrost cycle.

29. The method of claim 28 including the step of terminating the defrost cycle on the basis of a pre-scheduled time duration for the terminal phase.

30. The method of defrosting the cooling coil of a commercial product fixture comprising the steps of discontinuing the normal refrigerating phase of the cooling coil and initiating a defrost cycle by circulating warm coolant liquid through the cooling coil, and interrupting the circulation of warm coolant liquid and establishing a static charge thereof in the cooling coil for completing the defrost cycle.

31. The method of claim 30, including the step of monitoring the outlet temperature of warm coolant liquid exiting from the cooling coil during the initial phase of the defrost cycle, and stopping the flow of warm coolant liquid in the cooling coil when a predetermined outlet temperature is sensed.

32. The method of claim 30, in which the static charge forms a heat sink mass of warm coolant liquid, and the method includes the step of holding the static charge in the cooling coil for the terminal phase of the defrost cycle.

33. The method of claim 32, including the step of terminating the defrost cycle on the basis of a preselected time schedule for the terminal phase.

34. The method of claim 32, including the step of terminating the defrost cycle on the basis of sensing a predetermined operating parameter of the defrosting cooling coil.

35. The method of claim 30 in which the fixture cooling coil is normally refrigerated from a vapor compression system that includes condenser means, and the method of defrosting includes the step of providing warm heat exchanger means having a warming input circuit downstream of and deriving heat from the condenser means.

36. The method of claim 35 in which the circulation of warm coolant liquid is in the heating loop of a secondary coolant system, and the method includes the step of circulating coolant liquid in the heating loop through a warmed output circuit of the warm heat exchanger means.

37. The method of claim 35 in which the warming input circuit is directly connected to the refrigerant discharge side of the condenser means for receiving warming liquid condensate therefrom at substantially saturated temperature.

38. The method of claim 35 including the step of air cooling the condenser means.

39. The method of claim 35 in which the condenser means is fluid cooled in condenser heat exchanger means having a liquid coolant input circuit, and the warming input circuit being connected downstream of the condenser heat exchanger means for receiving warming coolant flow therefrom.

40. The method of claim 39, including the step of throttling the flow of liquid coolant through the condenser heat exchanger means for regulating condensing temperatures and warming fluid heat exchange through the warm heat exchanger means to the heating loop for defrost.

* * * * *